US006296155B1

(12) United States Patent
Smith

(10) Patent No.: US 6,296,155 B1
(45) Date of Patent: Oct. 2, 2001

(54) ACTUATOR WITH COMPRESSIBLE INTERNAL COMPONENT

(75) Inventor: Jeremy P. Smith, Loudon, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 0 days.

(21) Appl. No.: 09/521,783

(22) Filed: Mar. 9, 2000

(51) Int. Cl.[7] ..... B65D 83/00

(52) U.S. Cl. ..... 222/402.1; 222/402.7; 239/337

(58) Field of Search ..... 222/402.1, 402.17; 239/337

(56) References Cited

U.S. PATENT DOCUMENTS

| | | | | |
|---|---|---|---|---|
| 3,187,963 | * | 6/1965 | Anderson | 222/394 |
| 3,188,008 | | 6/1965 | Green . | |
| 3,191,816 | | 6/1965 | Fead et al. . | |
| 3,191,817 | | 6/1965 | Furutani . | |
| 3,206,082 | | 9/1965 | Green . | |
| 3,209,960 | | 10/1965 | Green . | |
| 3,292,827 | | 12/1966 | Frangos . | |
| 3,653,558 | | 4/1972 | Shay . | |
| 3,703,994 | | 11/1972 | Nigro . | |
| 3,795,350 | | 3/1974 | Shay . | |
| 3,861,570 | | 1/1975 | Green . | |
| 3,863,816 | | 2/1975 | Focht . | |
| 3,870,205 | | 3/1975 | Bucaro . | |
| 4,139,128 | | 2/1979 | Ewald . | |
| 4,257,560 | | 3/1981 | Diamond . | |
| 4,416,398 | | 11/1983 | Knickerbocker . | |
| 5,088,630 | * | 2/1992 | Arch et al. | 222/326 |
| 5,385,303 | | 1/1995 | Gosselin et al. . | |
| 5,901,907 | | 5/1999 | Hildebrandt . | |
| 5,971,230 | | 10/1999 | Tanaka . | |
| 6,070,770 | * | 6/2000 | Tada et al. | 222/635 |

FOREIGN PATENT DOCUMENTS

| | | | | |
|---|---|---|---|---|
| 0531606 A1 | * | 3/1993 | (DE) | B65D/83/44 |

* cited by examiner

*Primary Examiner*—Kevin Shaver
*Assistant Examiner*—Frederick C Nicolas
(74) *Attorney, Agent, or Firm*—Davis & Bujold, P.L.L.C.

(57) ABSTRACT

A valve assembly having both a primary low/fine product dispensing flow rate and a secondary high/coarse product dispensing flow rate. The primary low/fine product dispensing flow rate is achieved upon initial vertical depression of the valve stem while the high/coarse product dispensing rate is achieved upon maximum vertical depression of the valve stem. An internal compressible member is located within the valve assembly to provide a detectable indication, to an operator of the valve assembly, that further depression of the valve stem will increase the product flow dispensing rate from the primary low/fine dispensing rate to the secondary high/coarse dispensing rate. The internal compressible member is either a compressible spherical ball, located captively within the biasing spring between a lower surface of the valve stem and a floor of the valve housing, or a compressible cylindrical sleeve which captively surrounds the biasing spring and is located between a lower surface of the valve stem and a floor of the valve housing.

20 Claims, 3 Drawing Sheets

ACTUATOR WITH COMPRESSIBLE INTERNAL COMPONENT

FIELD OF THE INVENTION

The present invention relates to an improved actuator for a pressurized aerosol valve which has a first low/fine product dispensing spray position and a second high/coarse product dispensing flow position. The actuator valve includes an internal compressible component which remains uncompressed, when discharging product in the first low/fine product dispensing spray position, and is compressed, when discharging product in the second high/coarse dispensing position.

BACKGROUND OF THE INVENTION

Currently on the market, there are a variety of aerosol dispensers and valves which facilitate dispensing product in a desired manner. Some of the known aerosol dispensers and valves have more than one dispensing position to facilitate dispensing product at different flow rates, e.g a low and a high product dispensing rate for an aerosol product. However, these known systems are somewhat cumbersome to manufacture and require operator manipulation in order to dispense product at different product dispensing flow rates.

SUMMARY OF THE INVENTION

Wherefore, it is an object of the present invention to overcome the above mentioned shortcomings and drawbacks associated with the prior art variable low rate actuators.

Another object of the present invention is to provide an aerosol valve which has a first low/fine dispensing rate and a second high/coarse product dispensing rate with both product dispensing flow rates being achieved by merely applying downward pressured to the actuator button, e.g. the first low/fine dispensing rate occurs upon initial actuation of the actuator button and the second high/coarse dispensing rate occurs upon further depression of the actuator button of the aerosol valve.

Yet another object of the present invention is to provide an indication, which is readily detectable by an operator of the valve, so that the operator can instantly sense that any further depression of the valve stem will alter the product dispensing flow rate from the first low/fine product dispensing rate to the second high/coarse product dispensing rate. This facilitates the operator applying sufficient downward dispensing pressure of the aerosol valve to achieve a desired product dispensing flow rate.

Still another object of the present invention is to locate the compressible member within the valve housing so that the compressible member is always maintained in a proper position for use without requiring any operator manipulation or intervention to alter the product dispensing flow rate the valve.

A further object of the present invention is to form the compressible member from an elastomeric material which is readily compressed but re-expands back to original uncompressed state, of the elastomeric material, immediately upon an interruption of the applied compression force.

In the accompanying specification, references made to top and bottom or upper and lower and such references to be understood as referring to the orientation of the various components when placed on a pressurized canister and the canister is standing in an upright position. Reference is also made in this specification to the term "aerosol" and this term is not to be interpreted, in a restrictive scientific sense of a very fine dispersion of liquid droplets and air. Rather, the term is used and intended to cover a variety of different products which are dispensed from a pressurizable canister.

The present invention also relates to an improved mounting cup and valve assembly combination for an aerosol canister, the combination comprising:

- a mounting cup having a perimeter curl for securing the mounting cup to an opening of a desired canister, the mounting cup having a pedestal portion with a centrally located aperture therein;
- a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;
- the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion;
- wherein at least one second radial orifice is formed in the valve stem at a position spaced from the at least one first radial orifice, and a compressible elastomeric member is located within the interior cavity of the valve body and is uncompressed when the product to be dispensed is flowing solely through the at least one first radial orifice to provide a first low product dispensing flow rate, and the compressible elastomeric member is at least partially compressed when the product to be dispensed flows through both the at least one first radial orifice and the at least one second radial orifice to provide a second coarse product dispensing flow rate.

The present invention also relates to a pressurized spray canister comprising:

- a spray canister being closed at one end and having an opening being defined by a rim at an opposite end thereof;
- a mounting cup having a perimeter curl and a pedestal portion with a centrally located aperture therein, the perimeter curl of the mounting cup being connected to the rim of the spray canister to permanently support the valve assembly within the spray canister;
- a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;
- the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion; and
- a spray button, with a discharge orifice, being coupled to the product outlet of the valve stem to facilitate dispensing of the product from the pressurized spray canister;

wherein at least one second radial orifice is formed in the valve stem at a position spaced from the at least one first radial orifice, and a compressible elastomeric member is located within the interior cavity of the valve body and is uncompressed when the product to be dispensed is flowing solely through the at least one first radial orifice to provide a first low product dispensing flow rate, and the compressible elastomeric member is at least partially compressed when the product to be dispensed flows through both the at least one first radial orifice and the at least one second radial orifice to provide a second coarse product dispensing flow rate.

The present invention finally relates to a method of forming an improved mounting cup and valve assembly combination for an aerosol canister, the method comprising the steps of:

forming a spray canister being closed at one end and having an opening being defined by a rim at an opposite end thereof;

providing a mounting cup having a perimeter curl and a pedestal portion with a centrally located aperture therein, and connecting the perimeter curl of the mounting cup to the rim of the spray canister to permanently support the valve assembly within the spray canister;

providing a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

housing and crimping the valve assembly to the pedestal portion with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion; and coupling a spray button, with a discharge orifice, to the product outlet of the valve stem to facilitate dispensing of the product from the pressurized spray canister; and forming at least one second radial orifice in the valve stem at a position spaced from the at least one first radial orifice, and locating a compressible elastomeric member within the interior cavity of the valve body, and the compressible elastomeric member remaining uncompressed when the product to be dispensed is flowing solely through the at least one first radial orifice to provide a first low product dispensing flow rate, and at least partially compressing the compressible elastomeric member when the product to be dispensed flows through both the at least one first radial orifice and the at least one second radial orifice to provide a second coarse product dispensing flow rate.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
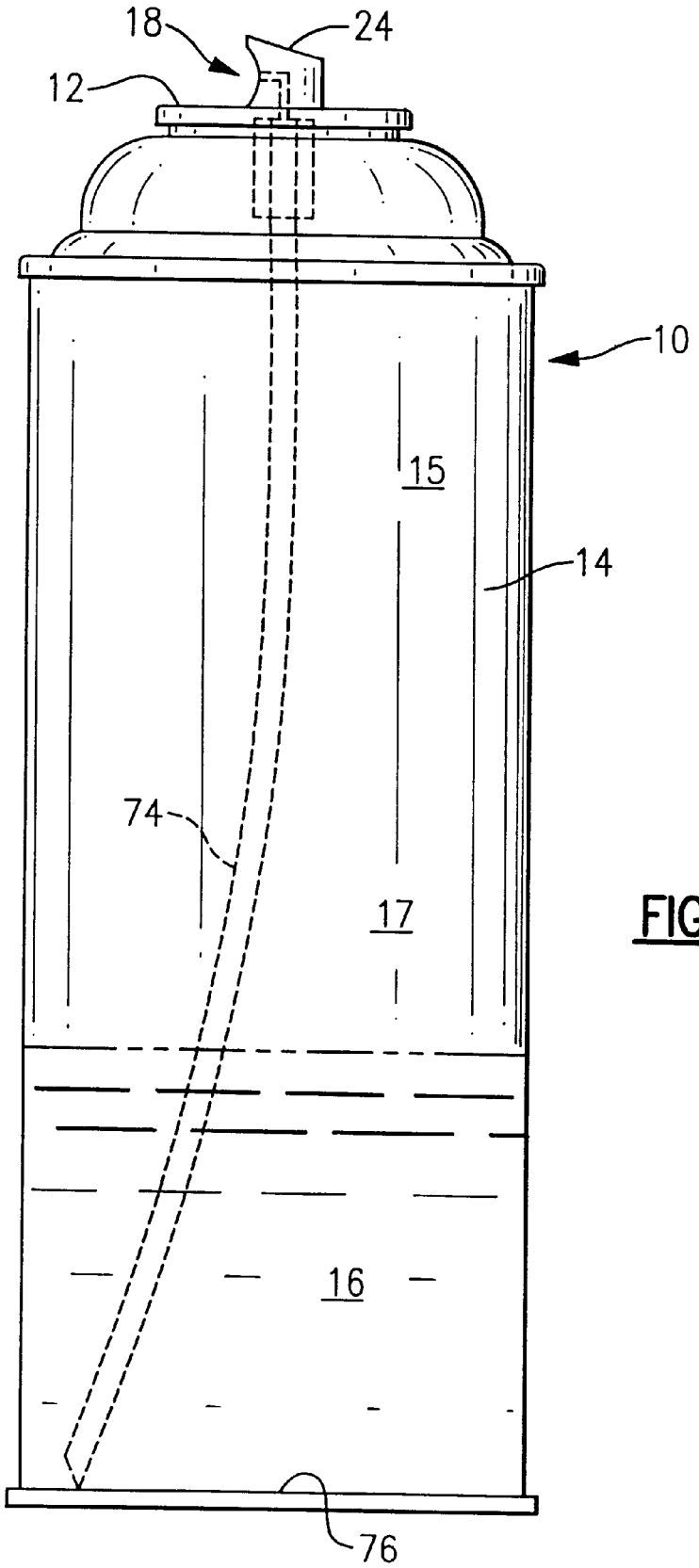
FIG. 1 is a diagrammatic front elevational view of a pressurized canister containing a vertical spray valve according to the present invention.

Turning now to FIG. 1, a brief description concerning the various components of the aerosol valve and the resulting aerosol canister will now be briefly discussed. As can be seen in this Figure, an aerosol or pressurizable canister 10 generally comprises a base canister 14, defining a product/propellent cavity 15 therein, which has an opening in a top portion of the base canister 14 for receiving a conventional mounting cup 12. Prior to the mounting cup 12 being attached to the base canister 14, an actuator assembly 18, typically comprising a vertical depressible valve, is crimped to a pedestal portion 34 of the mounting cup 12 in a conventional manner. Once this has occurred, the mounting cup 12, with the supported actuator assembly 18, is installed in an opening in the top of the base canister 14 and an outer periphery of the mounting cup 12 is crimped to the base canister 14 to form the pressurizable canister 10. As is conventional and well known in the art, the product/propellent cavity 15 of the pressurizable canister 10 is filled with a desired product to be dispensed 16 as well as a pressurized propellent 17 to facilitate dispensing of the desired product to be dispensed 16, as required by an operator. As such feature is conventional and well known in the art, a further detailed description concerning the same is not provided.

Figure 2:
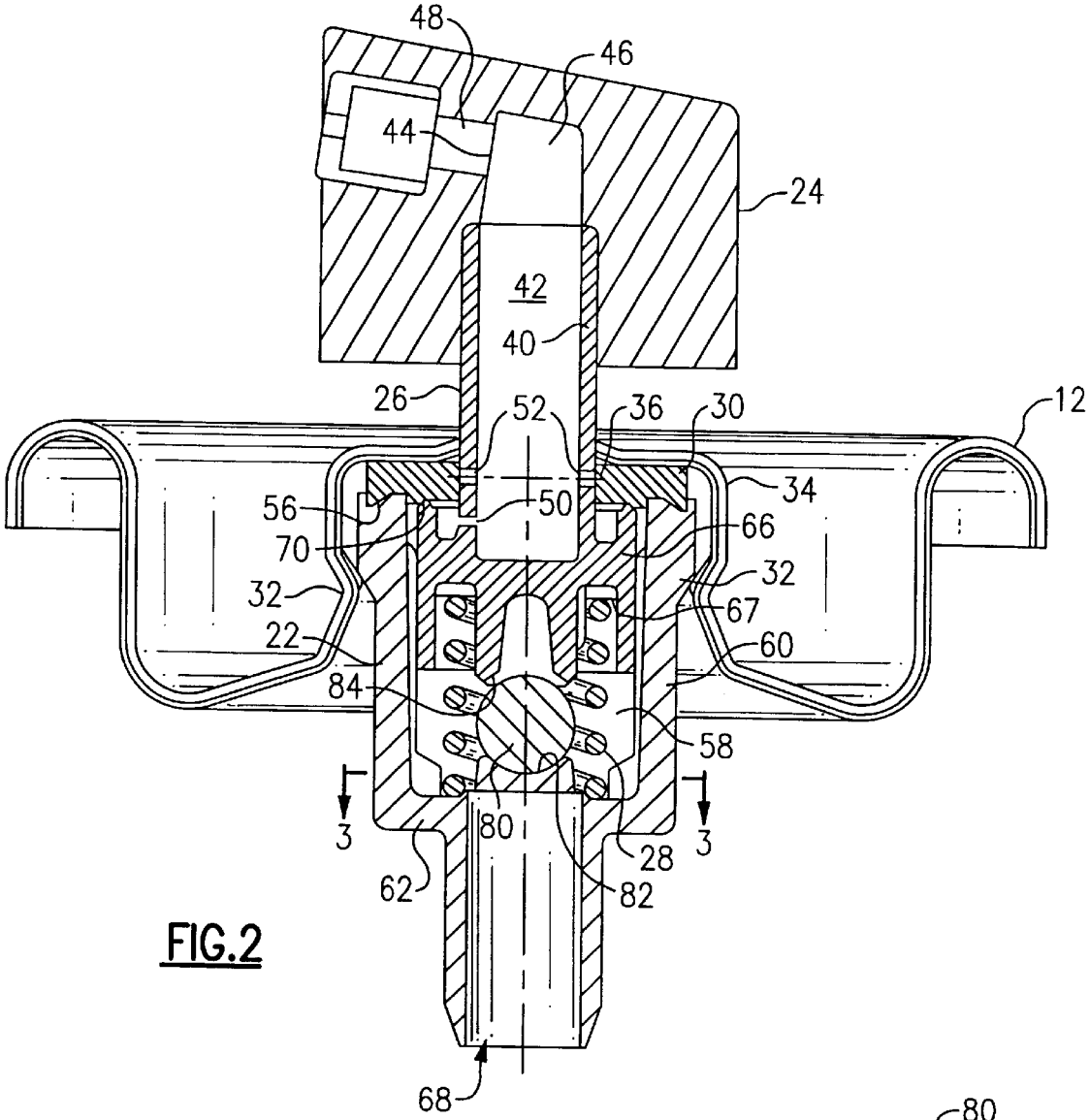
FIG. 2 is a diagrammatic cross-sectional view of a first embodiment of a vertical valve assembly, according to the present invention, shown installed on a mounting cup.
Figure 4:
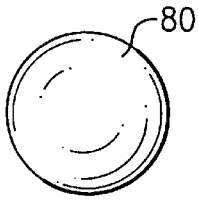
FIG. 4 is a diagrammatic perspective view of the compressible spherical ball contained within the vertical valve assembly of FIG. 2.
Figure 3:
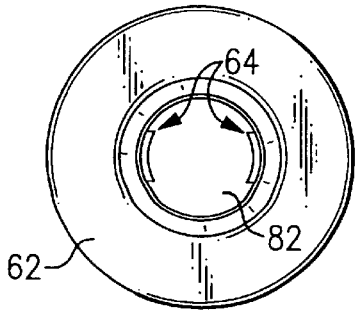
FIG. 3 is a cross-sectional view, along section line 3—3 of FIG. 2, of the vertical valve assembly.

Turning now to FIGS. 2–4, a detailed description concerning the various components of a first embodiment of the present invention will now be provided. As can be seen in this Figure, the mounting cup 12 supports the actuator assembly 18. The actuator assembly 18 comprises a valve body 22 having an internal cavity which supports an upstanding valve stem 26, a biasing spring 28 and a gasket 30. The valve stem 26, the biasing spring 28 and the gasket 30 are assembled within the internal cavity 58 of the valve body 22 and this assembly is then clamped or crimped to the mounting cup 12 by means of a plurality of indentations or crimps 32, e.g. four indentations or crimps are formed inwardly from the exterior of the sidewall of the pedestal portion 34 to permanently retain the this assembly to the mounting cup 12. The crimping operation forces the valve body 22 slightly upward, relative to the mounting cup 12, to bias and compressively seal the gasket 30 against the inwardly facing surface of the mounting cup 12. A portion of the valve stem 26 protrudes through a central aperture 36 provided in the pedestal portion 34 of the mounting cup 12 and supports the actuator button 24. The actuator button 24 has a central product inlet or aperture 40 therein which receives and fits over an exterior of the valve stem 26. The product inlet 40, in turn, communicates with a dispensing outlet 44 of the actuator button 24, via a button cavity 46 and at least one radial supply passageway 48.

The valve stem 26 includes a central bore 42 having a dispensing end which communicates with product inlet 40. The opposite end of the central bore 42 communicates with at least one first radial orifice 50, and possibly two, three, four or more first radial orifices 50 equally spaced about the circumference of the valve stem 26, which are each temporarily blocked from discharging product by a seal formed between the gasket 30 and an annular sealing rib 70 when the valve is in its normally closed position, as can be seen in FIG. 2. When the valve is sufficiently depressed by an operator, this seal is broken and communication is established between the first radial orifice(s) 50 and the interior cavity 58 of the valve body 22 for discharging the product to be dispensed from the pressurizable canister 10, during the dispensing process, at the first low/fine product dispensing rate.

At least one second radial orifice 52, and possibly two, three, four or more second radial orifices 52 equally spaced about the circumference of the valve stem 26, are also provided in the valve stem 26. The second radial orifice(s) 52 is/are spaced axially along the valve stem 26, in the direction of the actuator button 24, and is/are directly covered or blocked by engagement with the gasket 30. A further detailed description concerning the function of second radial orifice(s) 52 will follow below.

Figure 5:
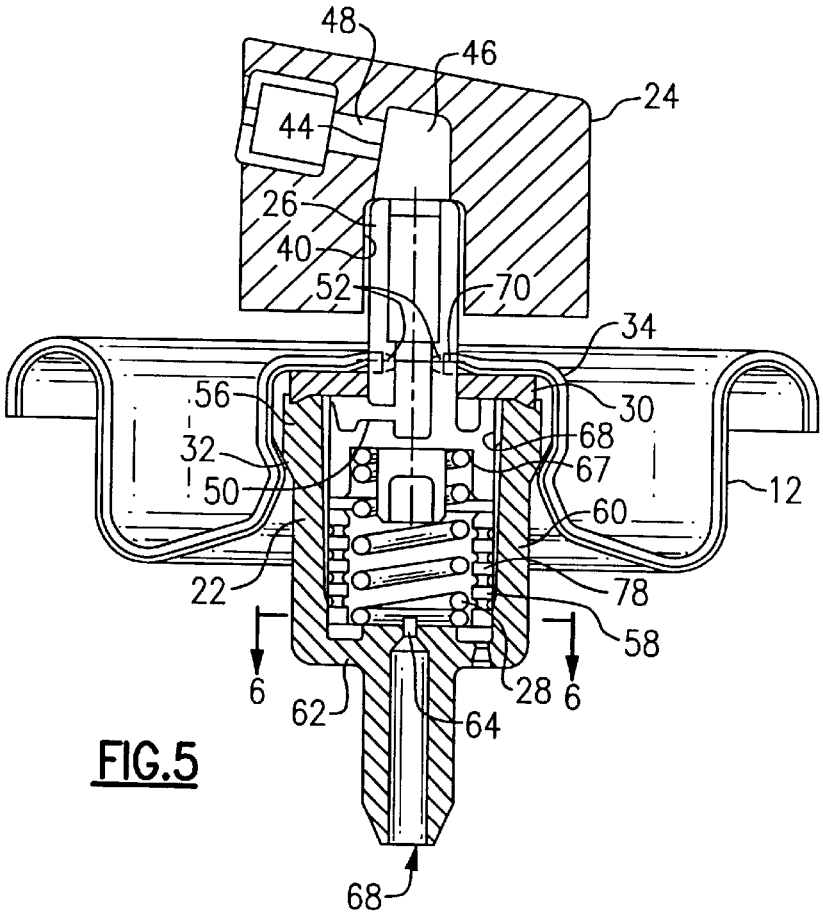
FIG. 5 is a diagrammatic cross-sectional view of a second embodiment of a vertical valve assembly, according to the present invention, shown installed on a mounting cup.
Figure 6:
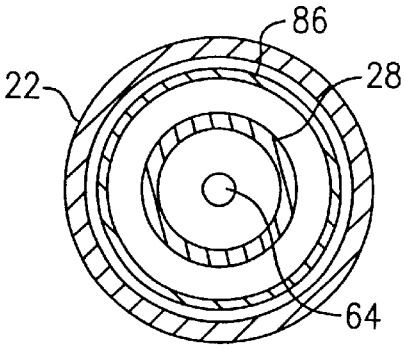
FIG. 6 is a cross-sectional view, along section line 6—6 of FIG. 5, of the vertical valve assembly.

The valve body 22 has a thickened mouth 56. The valve body 22 also includes a side wall 60 and a floor wall 62 which is provided with at least one inlet aperture 64, e.g. either a pair of inlet lateral apertures (FIG. 3) or an inlet central aperture (FIGS. 5 and 6). During the crimping operation with the pedestal portion 34, the plurality of indentations or crimps 32 engage a lower portion of the thickened mouth 56 and force the valve body 28 upwardly so as to compress and seal the gasket 30 against the inwardly facing surface of the mounting cup 12.

The valve stem 26 includes an enlarged head 66. The enlarged head 66 is centrally connected to the valve stem 26 and is formed at the lower end of the valve element. An annular recess 67 may be formed in the undersurface of the enlarged head 66 to receive and center a top portion of the spring 28. The upwardly facing surface of the enlarged head 66 is provided with an annular sealing rib 70 which normally seats against the lower or downwardly facing surface of the gasket 30 to form a fluid tight seal therebetween. The first and second radial orifices 50, 52 are located adjacent the enlarged head 66 and are both normally closed off by abutting engagement between the annular sealing rib 70 and sealing against the gasket 30 when the valve element is in its elevated normally closed position, shown in FIG. 2. The second radial orifice(s) 52 is/are additionally blocked by engagement with the gasket 30. The spring 28 is compressibly disposed between the floor 62 and the enlarged head 66 to urge the valve element away from the floor 62 into its elevated normally closed position.

A product inlet 68 communicates with an internal cavity 58 of the valve body 22, via the inlet central aperture 64, to supply a product to be dispensed to the valve. As can be seen in FIG. 3, a pair of opposed lateral apertures 64 are provided in the floor 62 of the valve body 22. A product dip tube 74 is fitted over the lower end of the valve body 22 and surrounds the product inlet 68. A lower end of the product dip tube 74 communicates with a base 76 of the pressurizable canister 16 to facilitate dispensing of the product to be dispensed therefrom as desired.

An elastomer compressible member 78 is incorporated within the actuator valve to provide additional depression resistance and indicate to the operator a transition from the first low/fine product dispensing spray position to the second high/coarse dispensing position. The elastomer compressible member 78, according to this embodiment of the present invention, is a compressible spherical ball 80 having a diameter of between 3/32 and 3/16 inches, for example. The compressible spherical ball 80 is designed to be located and captively retained within an interior area of the biasing spring 28. If desired, a lower portion of the floor 62 of the valve body can be formed as a partial spherical surface or seat 82 to facilitate maintaining the compressible spherical ball in a centrally located position within the biasing spring 28. In addition, a lower downwardly facing surface of the enlarged head 66 can be also be provided with a partially spherical surface or seat 84 to facilitate maintaining the compressible spherical ball 80 centered, with respect to the biasing spring 28, during compression thereof.

When an operator is dispensing, the above described valve operates in a conventional fashion. Upon initial depression of the actuator, the valve stem 26 compresses the biasing spring 28 which moves the annular sealing rib 70 out of abutting engagement with the gasket 30 and allows the product to be dispensed to flow up through the dip tube 74 into the internal cavity 58, via the inlet central aperture 64. The product to be dispensed 16 then flow between an inwardly facing surface of the valve body 22 and an outer surface of the enlarged head 66 of the valve stem 26. The product to be dispensed 16 then flows through the space formed between gasket 30 and the annular sealing rib 70 and through the first radial orifice(s) 50.

During such dispensing, a downwardly facing surface or seat 84 of the enlarged head 66 may be brought into slight contact with an upwardly facing surface of the compressible spherical ball 80 or may be slightly spaced therefrom, e.g. a one to a few thousands of an inch or so. An upwardly facing surface of the compressible spherical ball 80 is spaced a distance of about 0.020 inches or so from a downwardly facing surface of the enlarged head 66 so that the downwardly facing surface of the enlarged head 66 only contacts the compressible spherical ball 80 once the valve stem 26 is sufficiently depressed by the operator to dispense product through both the first radial orifice(s) 50 and the second radial orifice(s) 52.

The product to be dispensed is next conveyed to the dispensing outlet 44, via product inlet 40, the button cavity 46 and the at least one radial passageway 48 and thereafter dispensed directly into the atmosphere. If desired, a conventional insert member (not shown), having a centrally located dispensing orifice disposed therein for imparting a desired spray formation of the product to be dispensed, may be located in the dispensing outlet 44 to facilitate dispensing of the product to be dispensed in a desired spray configuration or pattern. As such insert member is conventional and well known in the art, a further detailed description concerning the same is not provided.

It is to be appreciated that during a first degree of depression of the valve stem 26, the at least one second radial orifice(s) 52 is still in communication with a radially inwardly facing surface of the gasket 30 to prevent any product to be dispensed from communicating with and flowing through the at least one second radial orifice(s) 52 so that all of the product to be dispensed 16 is conveyed solely via the at least one radial orifice(s) 50. This insures that the product to be dispensed is dispensed according to the product flow design parameters of the at least one first radial orifice(s) 50.

Assuming that the operator then sufficiently depresses the valve stem 26 by a further amount to at least partially compress the compressible spherical ball 80, the product to be dispensed is then dispensed at the second high/coarse product dispensing flow rate, i.e. the valve now provides communication with both the first and second transverse passage-ways 50, 52. The compression of the compressible spherical ball 80, by the operator, requires increased downward depression force on the actuator button 24 and the exact location at which the compressible spherical ball 80 engages with the seat 84 of the enlarged head 66 to commence compression of the compressible spherical ball 80 is readily sensed and detected by the operator. Once this occurs, the product to be dispensed then flows between the gasket 30 and the annular sealing rib 70, through both the first radial orifice(s) 50 and also through the second radial orifice(s) 52. The increase flow rate of the product to be dispensed is conveyed to the dispensing outlet 44, via the product inlet 40, the button cavity 46 and the at least one radial passageway 48 and thereafter dispensed directly into the atmosphere, as described above. The product to be dispensed 16 will be continued to be dispensed at the high/coarse product dispensing flow rate for so long as the operator maintains the valve stem in a sufficiently depressed second state to allow product dispensing through both the first radial orifice(s) 50 and the second radial orifice(s) 52.

Figure 7:
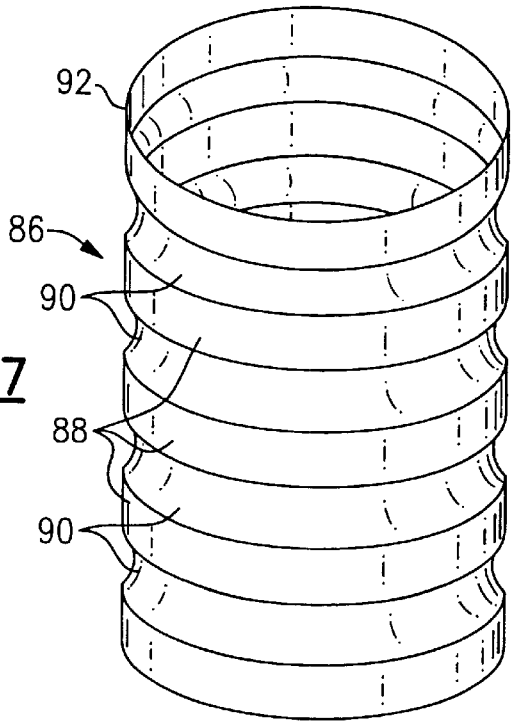
FIG. 7 is a diagrammatic perspective view of the compressible cylindrical sleeve contained within the vertical valve assembly of FIG. 5.

With respect to FIGS. 5–7, a brief description concerning a second embodiment of the present invention will now be provided. As this embodiment is substantially identical to the previous embodiment, except for (1) the valve housing is provided with an additional port in a base wall thereof, (2) the shape of the elastomer compressible member 78 and (3) the location of the elastomer compressible member 78 within the valve, a detailed description concerning only such differences of the elastomer compressible member 78 will be provided.

As seen in this embodiment, the elastomer compressible member 78 is a compressible cylindrical sleeve 86 which is located within the internal cavity 58 surrounds the biasing spring 28 of the valve assembly rather than being surrounding thereby. The compressible cylindrical sleeve 86 has a diameter which is larger than a diameter of the biasing spring 28 but slightly smaller than an inner diameter of the internal cavity 58 to allow the compressible cylindrical sleeve 86 to be readily received and maintained at a proper location within the valve housing 22.

The compressible cylindrical sleeve 86 is provided with a plurality, e.g. about five, annular ribs 88 which are each separated or spaced from one another by a thin resilient compressible wall 90. During compression of the compressible cylindrical sleeve 86, the annular ribs 88 are moved close to one another but remain substantially uncompressed while the thinner resilient compressible walls 90 are compressed to facilitate a reduction in an overall axial length of the compressible cylindrical sleeve 86. Such reduction of the compressible cylindrical sleeve 86 allows the at least one second radial orifice(s) 52 to be lowered out of communication with a radially inwardly facing surface of the gasket 30 and facilitate the flow of the product to be dispensed therethrough.

The upwardly facing top surface 92 of the compressible cylindrical sleeve 86 is spaced a distance of about 0.015 inches or so from a downwardly facing surface of the enlarged head 66 so that the downwardly facing surface of the enlarged head 66 only contacts the upwardly facing top surface 92 of the compressible cylindrical sleeve 86 once the valve stem 26 is sufficiently depressed by the operator to dispense product through both the first radial orifice(s) 50 and the second radial orifice(s) 52.

During dispensing by an operator according to this second embodiment, upon initial depression of the actuator, the valve stem 26 compresses the biasing spring 28 which moves the annular sealing rib 70 out of abutting engagement with the gasket 30 and allows the product to be dispensed 16 to flow up through the dip tube 68, via the at least one inlet aperture 64, into the internal cavity 58. The product to be dispensed 16 then flows between an inwardly facing surface of the valve body 22 and an outer surface of the enlarged head 66 of the valve stem 26. The product to be dispensed 16 flows through the space formed between the gasket 30 and the annular sealing rib 70 and through the first radial orifice(s) 50 (the at least one second radial orifice(s) 52 is still in communication with a radially inwardly facing surface of the gasket 30 to prevent the flow of any product to be dispensed therethrough). The product to be dispensed 16 is conveyed to the dispensing outlet 44, via the product inlet 40, the button cavity 46 and the at least one radial passageway 48 and thereafter dispensed directly into the atmosphere. During such dispensing, a downwardly facing surface of the enlarged head 66 of the valve stem 26 may be brought in to slight contact with the upwardly facing top surface 92 of the compressible cylindrical sleeve 86 or may be slightly spaced therefrom.

Assuming that the operator then sufficiently depresses the valve stem 26 to at least partially compress the compressible cylindrical sleeve 86, the product to be dispensed is then dispensed at the second high/coarse product dispensing flow rate, i.e. to provide communication with both the first and second radial orifices 50, 52. The compression of the compressible cylindrical sleeve 86, by the operator, requires an increased downward depression force on the actuator button 24 and the exact location where the compressible cylindrical sleeve 86 is engaged and commences compression is readily sensed and detected by the operator. That is, the product to be dispensed 16 then flows between the gasket 30 and the annular sealing rib 70, through both the first radial orifice(s) 50 and the second radial orifice(s) 52. The increase flow rate of the product to be dispensed 16 is conveyed to the dispensing outlet 44, via the product inlet 40, the button cavity 46 and the at least one radial passageway 48 and thereafter dispensed directly into the atmosphere, as described above. The product to be dispensed 16 will be continued to be dispensed at the high/coarse product dispensing flow rate for so long as the operator maintains the valve stem in a sufficiently depressed second state to allow product dispensing through both the first radial orifice(s) 50 and the second radial orifice(s) 52.

Each at least one first radial orifice(s) 50 has a cross-sectional diameter of about 0.011 to about 0.025 inches while each at least one second radial orifice(s) 52 has a cross-sectional diameter of about 0.013 to about 0.040 inches. The at least one first radial orifice(s) 50 and the at least one second radial orifice(s) 52 are preferably axially spaced from one another, along the valve stem, by a distance of between 0.040 and about 0.060 inches. This axially spacing distance allows the operator to facilitate dispensing of the actuator button 24 in either one of its two available dispensing positions.

The internal compressible member 78 is preferably an elastomeric component which is manufactured from one of the following components: ultra low density polyethylene, thermoplastic rubber or other synthetic rubber, etc. In a preferred form of the invention, the internal compressible member 78 is sufficiently rigid so that the operator will readily detect once the seat or the lower surface of the valve stem abuts against a top upwardly facing surface of the internal compressible member 86 to sandwich the internal compressible member 86 between the seat or the lower surface of the valve stem and the upwardly facing base surface of the valve assembly.

Since certain changes may be made in the above described improved actuator with compressible internal component, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. An improved mounting cup and valve assembly combination for an aerosol canister, the combination comprising:

a mounting cup having a perimeter curl for securing the mounting cup to an opening of a desired canister, the mounting cup having a pedestal portion with a centrally located aperture therein;

a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion;

wherein at least one second radial orifice is formed in the valve stem at a position spaced from the base portion of the valve stem with the at least one first radial orifice located therebetween, and a compressible elastomeric member, having a solid continuous uninterrupted exterior wall without any voids therein, is located within the interior cavity of the valve body and is uncompressed when the product to be dispensed is flowing solely through the at least one first radial orifice to provide a first low product dispensing flow rate, and the compressible elastomeric member is at least partially compressed and directly contacts an adjacent surface of the bottom portion of the valve stem when the product to be dispensed flows through both the at least one first radial orifice and the at least one second radial orifice to provide a second coarse product dispensing flow rate.

2. The valve assembly combination according to claim 1, wherein a remote portion of the valve body has a dip tube coupling having a product inlet formed therein, and a first end of a dip tube is coupled to the dip tube coupling, and the dip tube facilitates conveyance of the product to be dispensed to the interior cavity of the valve body.

3. The valve assembly combination according to claim 1, wherein a spring is located within the interior cavity of the valve body and normally biases an annular perimeter sealing rib of base portion of the valve stem into engagement with the gasket to provide a fluid tight seal therebetween and maintain the valve in a normally closed position.

4. The valve assembly combination according to claim 1, wherein the valve assembly combination further includes an actuator button having a product inlet which receives and fits over an exterior surface of the valve stem, and the product inlet communicates with a dispensing outlet via at least one radial supply passageway.

5. The valve assembly combination according to claim 1, wherein the at least one first radial orifice and the at least one second radial orifice each have a cross-sectional dimension of between 0.011 and 0.040 inch; and the at least one first radial orifice is spaced axially, along the valve stem, from the at least one second radial orifice by distance of between 0.040 and 0.060 inch.

6. The valve assembly combination according to claim 1, wherein the compressible elastomeric member is manufactured from one of polyethylene, thermoplastic rubber and other synthetic rubber.

7. An improved mounting cup and valve assembly combination for an aerosol canister, the combination comprising:

a mounting cup having a perimeter curl securing the mounting cup to an opening of a desired canister, the mounting cup having a pedestal portion with a centrally located aperture therein;

a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion;

wherein at least one second radial orifice is formed in the valve stem at a position spaced from the base portion of the valve stem with the at least one first radial orifice located therebetween, and a compressible elastomeric member is located within the interior cavity of the valve body and is uncompressed when the product to be dispensed is flowing solely through the at least one first radial orifice to provide a first low product dispensing flow rate, and the compressible elastomeric member is at least partially compressed when the product to be dispensed flows through both the at least one first radial orifice and the at least one second radial orifice to provide a second coarse product dispensing flow rate; and a spring is located within the interior cavity of the valve body and normally biases the valve stem into engagement with the gasket to provide a fluid tight seal therebetween, and the compressible elastomeric member comprises a spherical ball which is located within a circumferential area defined by the spring.

8. The valve assembly combination according to claim 7, wherein a central upwardly facing surface of a floor of the valve housing has a spherical seat and a mating downwardly facing surface of the base portion of the valve housing has a valve seat to facilitate centering and compression of the compressible spherical ball therebetween upon dispensing the product to be dispensed at the second coarse product dispensing flow rate.

9. An improved mounting cup and valve assembly combination for an aerosol canister, the combination comprising:

a mounting cup having a perimeter curl securing the mounting cup to an opening of a desired canister, the mounting cup having a pedestal portion with a centrally located aperture therein;

a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion;

wherein at least one second radial orifice is formed in the valve stem at a position spaced from the base portion of the valve stem with the at least one first radial orifice located therebetween, and a compressible elastomeric member is located within the interior cavity of the valve body and is uncompressed when the product to be dispensed is flowing solely through the at least one first radial orifice to provide a first low product dispensing flow rate, and the compressible elastomeric member is at least partially compressed when the product to be dispensed flows through both the at least one first radial orifice and the at least one second radial orifice to provide a second coarse product dispensing flow rate; and a spring is located within the interior cavity of the valve body and normally biases the valve stem into engagement with the gasket to provide a fluid tight seal therebetween, and the compressible elastomeric member comprises a compressible cylindrical sleeve which is accommodated within the internal cavity of the valve body and surrounds the spring.

10. The valve assembly combination according to claim 9, wherein the compressible cylindrical sleeve comprises a plurality of spaced apart annular ribs which are connected to one another by a resilient compressible wall to facilitate compression, when dispensing the product to be dispensed at the second coarse product dispensing flow rate, and re-expansion of a compressible cylindrical sleeve following termination of dispensing the product to be dispensed at the second coarse product dispensing flow rate.

11. A pressurized spray canister comprising:

a spray canister being closed at one end and having an opening being defined by a rim at an opposite end thereof;

a mounting cup having a perimeter curl and a pedestal portion with a centrally located aperture therein, the perimeter curl of the mounting cup being connected to the rim of the spray canister to permanently support a valve assembly within the spray canister;

a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion; and a spray button, with a discharge orifice, being coupled to the product outlet of the valve stem to facilitate dispensing of the product from the pressurized spray canister;

wherein at least one second radial orifice is formed in the valve stem at a position spaced from the base portion of the valve stem with the at least one first radial orifice located therebetween, and a compressible elastomeric member, having a solid continuous uninterrupted exterior wall without any voids therein, is located within the interior cavity of the valve body and is uncompressed when the product to be dispensed is flowing solely through the at least one first radial orifice to provide a first low product dispensing flow rate, and the compressible elastomeric member is at least partially compressed and directly contacts an adjacent surface of the bottom portion of the valve stem when the product to be dispensed flows through both the at least one first radial orifice and the at least one second radial orifice to provide a second coarse product dispensing flow rate.

12. The spray canister according to claim 11, wherein a remote portion of the valve body has a dip tube coupling having a product inlet formed therein, and a first end of a dip tube is coupled to the dip tube coupling, and the dip tube facilitates conveyance of the product to be dispensed to the interior cavity of the valve body, and spring is located within the interior cavity of the valve body and normally biases an annular perimeter sealing rib of base portion of the valve stem into engagement with the gasket to provide a fluid tight seal therebetween and maintain the valve in a normally closed position.

13. The spray canister according to claim 11, wherein the compressible elastomeric member is manufactured from one of thermoplastic rubber, synthetic rubber and polyethylene.

14. The spray canister according to claim 11, wherein the at least one first radial orifice and the at least one second radial orifice each have a cross-sectional dimension of between 0.011 and 0.040 inch, and the at least one first radial orifice is spaced axially, along the valve stem, from the at least one second radial orifice by distance of between 0.040 and 0.060 inches.

15. A pressurized spray canister comprising:

a spray canister being closed at one end and having an opening being defined by a rim at an opposite end thereof;

a mounting cup having a perimeter curl and a pedestal portion with a centrally located aperture therein, the perimeter curl of the mounting cup being connected to the rim of the spray canister to permanently support a valve assembly within the spray canister;

a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion; and a spray button, with a discharge orifice, being coupled to the product outlet of the valve stem to facilitate dispensing of the product from the pressurized spray canister;

wherein at least one second radial orifice is formed in the valve stem at a position spaced from the base portion of the valve stem with the at least one first radial orifice located therebetween, and a compressible elastomeric member is located within the interior cavity of the valve body and is uncompressed when the product to be dispensed is flowing solely through the at least one first radial orifice to provide a first low product dispensing flow rate, and the compressible elastomeric member is at least partially compressed when the product to be dispensed flows through both the at least one first radial orifice and the at least one second radial orifice to provide a second coarse product dispensing flow rate; an a spring is located within the interior cavity of the valve body and normally biases the valve stem into engagement with the gasket to provide a fluid tight seal therebetween, and the compressible elastomeric member comprises a spherical ball which is located within a circumferential area defined by the spring.

16. The spray canister according to claim 15, wherein a central upwardly facing surface of a floor of the valve housing has a spherical seat and a mating downwardly facing surface of the base portion of the valve housing has a valve seat to facilitate centering and compression of the compressible spherical ball therebetween upon dispensing the product to be dispensed at the second coarse product dispensing flow rate.

17. A pressurized spray canister comprising:

a spray canister being closed at one end and having an opening being defined by a rim at an opposite end thereof;

a mounting cup having a perimeter curl and a pedestal portion with a centrally located aperture therein, the perimeter curl of the mounting cup being connected to the rim of the spray canister to permanently support a valve assembly within the spray canister;

a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

the valve assembly being housed within the pedestal portion and being crimped thereto with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion; and a spray button, with a discharge orifice, being coupled to the product outlet of the valve stem to facilitate dispensing of the product from the pressurized spray canister;

wherein at least one second radial orifice is formed in the valve stem at a position spaced from the base portion of the valve stem with the at least one first radial orifice located therebetween, and a compressible elastomeric member is located within the interior cavity of the valve body and is uncompressed when the product to be dispensed is flowing solely through the at least one first radial orifice to provide a first low product dispensing flow rate, and the compressible elastomeric member is at least partially compressed when the product to be dispensed flows through both the at least one first radial orifice and the at least one second radial orifice to provide a second coarse product dispensing flow rate; and a spring is located within the interior cavity of the valve body and normally biases the valve stem into engagement with the gasket to provide a fluid tight seal therebetween, and the compressible elastomeric member comprises a compressible cylindrical sleeve which is accommodated within the internal cavity of the valve body and surrounds the spring.

18. The spray canister according to claim 17, wherein compressible cylindrical sleeve comprises a plurality of spaced apart annular ribs which are connected to one another by a resilient compressible wall to facilitate compression, when dispensing the product to be dispensed at the second coarse product dispensing flow rate, and re-expansion of a compressible cylindrical sleeve following termination of dispensing the product to be dispensed at the second coarse product dispensing flow rate.

19. A method of forming an improved mounting cup and valve assembly combination for an aerosol canister, the method comprising the steps of:

forming a spray canister being closed at one end and having an opening being defined by a rim at an opposite end thereof;

providing a mounting cup having a perimeter curl and a pedestal portion with a centrally located aperture therein, and connecting the perimeter curl of the mounting cup to the rim of the spray canister to permanently support the valve assembly within the spray canister;

providing a valve assembly having valve body with a product inlet communicating with an interior cavity of the valve body, a product outlet being formed in a valve stem, a base portion of the valve stem being at least partially supported within the interior cavity of the valve body, and at least one first radial orifice being formed in the valve stem, adjacent the base portion, to provide communication with the product outlet of the valve stem;

housing and crimping the valve assembly to the pedestal portion with a gasket being located between a perimeter sealing surface of the base portion of the valve stem and an adjacent inwardly facing surface of the pedestal portion with a portion of the valve stem, supporting the product outlet, protruding through an aperture provided in the gasket and the centrally located aperture of the pedestal portion; and coupling a spray button, with a discharge orifice, to the product outlet of the valve stem to facilitate dispensing of the product from the pressurized spray canister; and forming at least one second radial orifice in the valve stem at a position spaced from the base portion of the valve stem with the at least one first radial orifice located therebetween, and locating a compressible elastomeric member, having a solid continuous uninterrupted exterior wall without any voids therein, within the interior cavity of the valve body, and the compressible elastomeric member remaining uncompressed when the product to be dispensed is flowing solely through the at least one first radial orifice to provide a first low product dispensing flow rate, and at least partially compressing and directly contacting the compressible elastomeric member with an adjacent surface of the valve stem when the product to be dispensed flows through both the at least one first radial orifice and the at least one second radial orifice to provide a second coarse product dispensing flow rate.

20. The method according to claim 19, further comprising the steps of forming a dip tube coupling, having a product inlet formed therein, on the valve body, and connecting a first end of a dip tube with the dip tube coupling to facilitate communication between a product to be dispensed and the interior cavity of the valve body, and locating a spring within the interior cavity of the valve body and normally biasing an annular perimeter sealing rib of base portion of the valve stem into engagement with the gasket to provide a fluid tight seal therebetween and maintain the valve in a normally closed position.

* * * * *